US011359400B2

(12) United States Patent
Huffman et al.

(10) Patent No.: US 11,359,400 B2
(45) **Date of Patent: *Jun. 14, 2022**

(54) SHADE-PROVIDING STRUCTURE

(71) Applicant: PlayCore Wisconsin, Inc., Chattanooga, TN (US)

(72) Inventors: Jonathan Huffman, Grants Pass, OR (US); Tim Millard, Grants Pass, OR (US); Wesley Hutchinson, Selma, OR (US)

(73) Assignee: PLAYCORE WISCONSIN, INC., Chattanooga, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/989,477

(22) Filed: Aug. 10, 2020

(65) Prior Publication Data

US 2020/0370327 A1 Nov. 26, 2020

Related U.S. Application Data

(63) Continuation of application No. 16/579,289, filed on Sep. 23, 2019, now Pat. No. 10,738,502.

(Continued)

(51) Int. Cl.
*E04H 15/02* (2006.01)
*E04H 15/32* (2006.01)

(Continued)

(52) U.S. Cl.
CPC ..... *E04H 15/64* (2013.01); *E04H 15/02* (2013.01); *E04H 15/322* (2013.01); *E04H 15/34* (2013.01);

(Continued)

(58) Field of Classification Search
CPC ..... E04H 15/322; E04H 15/646; E04H 15/34; A45B 2023/0093
See application file for complete search history.

(56) References Cited

U.S. PATENT DOCUMENTS 2,293,329 A 8/1942 Coburn
2,604,897 A * 7/1952 Cottor ..... B60J 7/104 135/119

(Continued)

FOREIGN PATENT DOCUMENTS

DE 2655045 A1 6/1978
EP 3626315 A1 * 3/2020 ..... A63B 5/11

(Continued)

*Primary Examiner* — Robert Canfield
(74) *Attorney, Agent, or Firm* — McAndrews, Held & Malloy, Ltd.

(57) ABSTRACT

The present invention relates to an easily assembled and disassembled shade-providing structure, such as may be mounted to a playground assembly. The shade-providing structure comprises an outer frame defining an interior space and a canopy that may be positioned in that interior space. The canopy has one or more rods around its periphery, such as may be inserted through one or more pockets in the canopy fabric. Each of the outer frame and the rod(s) has a set of apertures configured to receive a locking fastener and a set of apertures configured to receive a jack screw or similar tensioning device. Accordingly, to assembly the structure, one or more jack screws can be used to provide the canopy with a desired tension and then locking fasteners can be used to secure the canopy to the outer frame.

20 Claims, 11 Drawing Sheets

Related U.S. Application Data

(60) Provisional application No. 62/734,705, filed on Sep. 21, 2018.

(51) Int. Cl.

| | |
|---|---|
| ***E04H 15/34*** | (2006.01) |
| ***E04H 15/44*** | (2006.01) |
| ***E04H 15/64*** | (2006.01) |
| ***A63B 9/00*** | (2006.01) |
| *A45B 23/00* | (2006.01) |
| *E04B 9/04* | (2006.01) |
| *A63B 5/11* | (2006.01) |

(52) U.S. Cl.

CPC ..... *E04H 15/44* (2013.01); *E04H 15/646* (2013.01); *A45B 2023/0093* (2013.01); *A63B 5/11* (2013.01); *A63B 2009/006* (2013.01); *E04B 2009/0492* (2013.01)

(56) References Cited

U.S. PATENT DOCUMENTS

| | | | | | |
|---|---|---|---|---|---|
| 3,025,866 | A | | 3/1962 | Cockrum | |
| 3,182,672 | A | | 5/1965 | Biller, Jr. | |
| 3,233,895 | A | * | 2/1966 | Grelle | A63B 5/11 482/27 |
| 3,948,515 | A | * | 4/1976 | McNeil | A63B 5/11 482/27 |
| 3,983,585 | A | * | 10/1976 | Sidlinger | A63B 5/11 482/27 |
| 4,569,362 | A | | 2/1986 | Fidler, Jr. | |
| 4,730,423 | A | | 3/1988 | Hughes | |
| 4,863,156 | A | * | 9/1989 | Shaw | A63B 5/11 482/27 |
| 6,001,045 | A | * | 12/1999 | Gift | A63B 5/11 482/27 |
| 6,165,106 | A | | 12/2000 | McBride et al. | |
| 6,213,138 | B1 | | 4/2001 | Wimpee | |
| 8,047,967 | B1 | * | 11/2011 | Teng | A63B 5/11 482/27 |
| 8,974,350 | B2 | * | 3/2015 | Hsiang | A63B 5/11 482/27 |
| 9,050,482 | B1 | * | 6/2015 | VanElverdinghe | A63B 5/11 |
| 2003/0056818 | A1 | | 3/2003 | Connelly et al. | |
| 2003/0226587 | A1 | * | 12/2003 | Godbersen | E04H 15/64 135/121 |
| 2007/0119489 | A1 | | 5/2007 | Haymann et al. | |
| 2012/0010050 | A1 | * | 1/2012 | Smith | A63B 69/407 482/27 |
| 2013/0061898 | A1 | | 3/2013 | Webster et al. | |
| 2013/0210590 | A1 | * | 8/2013 | Publicover | A63B 69/0097 482/110 |
| 2016/0311503 | A1 | | 10/2016 | Duplain | |
| 2017/0361143 | A1 | | 12/2017 | Mehr et al. | |
| 2020/0001162 | A1 | * | 1/2020 | Nilsson | A63B 71/0054 |
| 2022/0022613 | A1 | * | 1/2022 | Chen | A45B 19/06 |

FOREIGN PATENT DOCUMENTS

| | | | | | |
|---|---|---|---|---|---|
| FR | 2786218 | A1 | * | 5/2000 | A45B 23/00 |
| GB | 1248909 | A | * | 10/1971 | A63B 5/11 |
| KR | 102349170 | B1 | * | 1/2022 | E04H 15/34 |
| KR | 102351419 | B1 | * | 1/2022 | E04H 15/322 |

* cited by examiner

SHADE-PROVIDING STRUCTURE

The present application is a continuation of U.S. patent application Ser. No. 16/579,289, filed on Sep. 23, 2019, which claims priority to U.S. Provisional Application No. 62/734,705, filed on Sep. 21, 2018, the entireties of which are incorporated by reference herein.

BACKGROUND

Recreational areas such as parks and playgrounds often include one or more shade-providing structures. These shade-providing structures typically include a framework and a canopy that is tensioned and attached to the framework. In most cases, the assembly of those structures remains difficult. In particular, due to the large sizes of the canopies that are typically used, it is often difficult for an installer to provide the canopy with a desired degree of tension during the installation process. It is also often difficult to re-tension a canopy during the lifetime of the structure. The present invention discloses a new shade-providing structure that is easy to tension both during installation and throughout the lifetime of the structure.

SUMMARY OF THE INVENTION

The present invention relates to a shade-providing structure, such as may be mounted to a playground assembly, and to a playground assembly comprising that shade-providing structure.

Embodiments of the shade-providing structure may comprise an outer frame defining an interior space and a canopy that may be positioned in that interior space. The canopy may have one or more rods installed around its periphery, such as by insertion through one or more pockets in the canopy fabric. Each of the outer frame and the rod(s) may have a set of apertures configured to receive a locking fastener and a set of apertures configured to receive a jack screw or similar tensioning device. To assembly the structure, therefore, one or more jack screws can be operated to provide the canopy with a desired tension and then locking fasteners can be used to secure the canopy to the outer frame.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

The present disclosure is directed to shade-providing structures 10, such as may be used to provide shade to a portion of a playground. An embodiment of such a shade-providing structure 10 is shown in FIG. 1.

Figure 1:
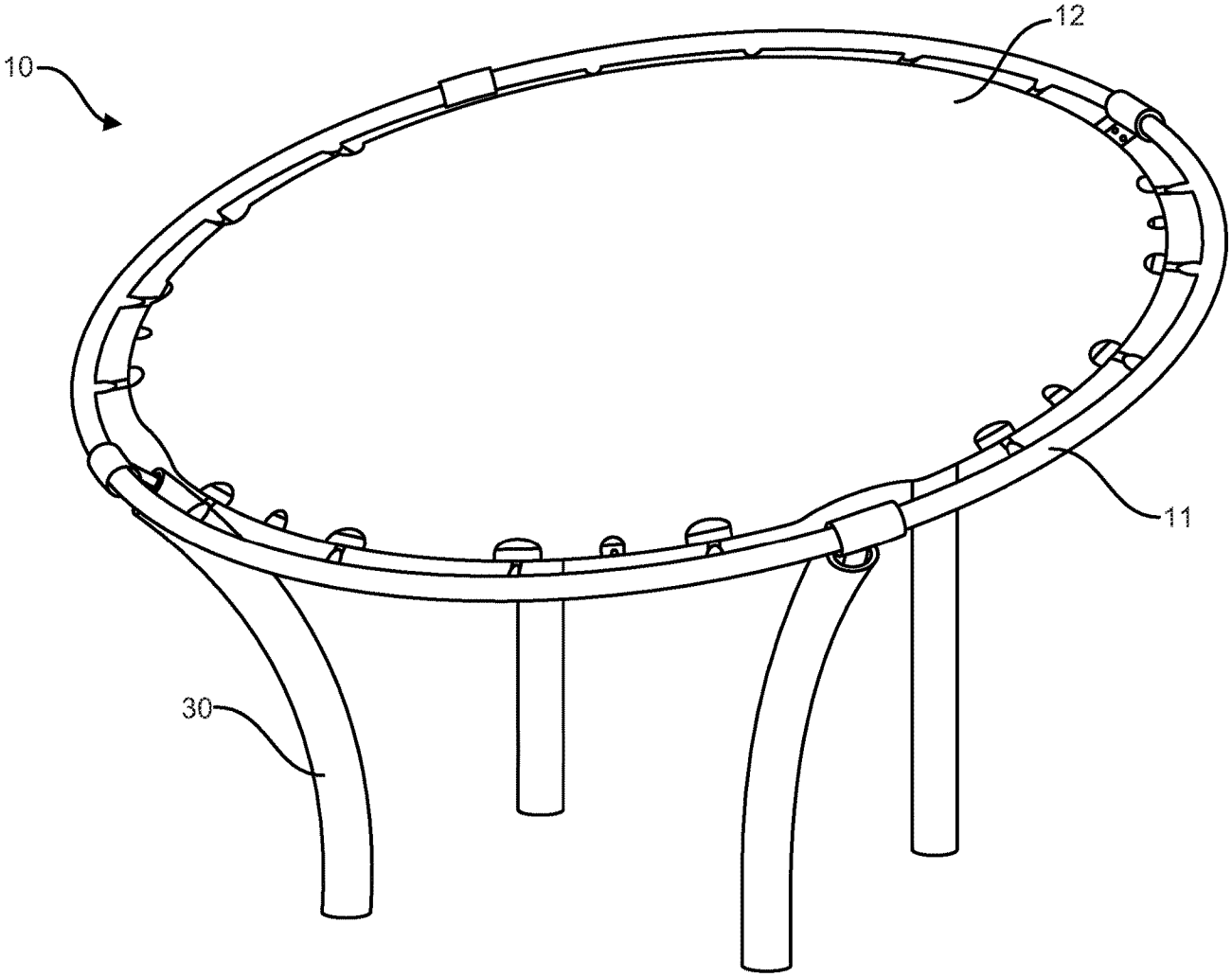
FIG. 1 is a perspective view of a shade-providing structure according to an embodiment of the present disclosure.

The shade-providing structure of FIG. 1 comprises an outer frame 11 and a canopy 12. The outer frame 11 defines an interior space, into which the canopy 12 is positioned.

The outer frame 11 is shown as having a circular shape. However, the outer frame 11 may also have other well-recognizable shapes, such as oval, polygonal, etc. In other embodiments, the outer frame 11 may have a themed shape, such as may relate to a theme of a playground or a playground structure to which the structure 10 is associated. The outer frame 11 is desirably made from a high-strength and weather-resistance material. For instance, in some embodiments, the outer frame may be a steel tube. A protective coating may be applied to the outer frame, such as through galvanization.

The canopy 12 is positioned within the interior space defined by the outer frame 11 and securely affixed to the outer frame. The canopy 12 of FIG. 1 is shown as having a circular shape. However, the canopy may also have other well-recognizable shapes, such as oval, polygonal, etc. In other embodiments, the canopy 12 may have a themed shape, such as may relate to a theme of a playground or a playground structure to which the structure 10 is associated.

In some embodiments, the shape of the canopy 12 may substantially correspond with the shape of the outer frame 11. In the illustrated embodiment, for instance, both the outer frame 11 and the canopy 12 are circular in shape. Similarly, both the outer frame 11 and the canopy 12 may be of the same polygonal shape or of the same themed shape. In other embodiments, however, the shape of the canopy 12 may not correspond with the shape of the outer frame 11. For instance, a canopy 12 having a themed, and potentially complex, shape may be designed to be mounted within the interior space of a circular or polygonal outer frame 11. The ability to have different sections of the canopy 12 tensioned independently (as described herein) allows one to obtain embodiments of a shade-providing structure in which a canopy having a complex shape may be held tautly within the outer frame 11.

The canopy 12 comprises a canopy material 13, such as a fabric canopy sheet. The canopy material 13 is desirably resistant to water damage and/or sun damage (e.g. fading). As shown in FIG. 1, the canopy material 13 may comprise one or more pockets 14 around its periphery. For instance, as in the illustrated embodiment, the canopy material 13 may have a plurality of pockets 14 that together extend around substantially the entire periphery. In other embodiments, however, the canopy material 13 may have a single pocket 14 extending around its entire periphery or substantially the entire periphery.

The canopy 12 also comprises one or more rods 15 that may be positioned within the one or more pockets 14 of the canopy material 13. Once inserted through the one or more pockets 14, the one or more rods 15 may act as a peripheral framework for the canopy material 13. The one or more rods 15 may be made of any of a variety of materials, including for example steel, aluminum, fiberglass, or the like. In some embodiments, the one or more rods 15 may be flexible, while in other embodiments the rods 15 may be substantially rigid (though the rods will desirably have at least some degree of flexibility in order to assist with tensioning).

In some embodiments, a single rod 15 may be inserted around the periphery or substantially the periphery of the canopy material 13. In other embodiments a plurality of rods 15 may be inserted into various subsections of the periphery of the canopy material 13. For instance, in the embodiment illustrated in FIG. 1, four rods 15 are inserted into pockets 14 positioned around the periphery of the canopy material 13. More specifically, each of the four rods 15 spans substantially across the periphery of a quadrant of the circular canopy material 13. By using a plurality of rods 15, each subsection of the canopy 12 may be independently tensioned. For instance, in the embodiment illustrated in FIG. 1, each quadrant of the circular canopy material 13 may be independently tensioned to achieve a taut canopy 12. Similarly, because the tension of each quadrant of the circular canopy material 13 may be adjusted independently, post-installation adjustments (such as may be needed over time) are simple to perform.

The canopy 12 may be connected to the outer frame 11 in a variety of manners. In some embodiments, the canopy 12 may be connected to the outer frame 11 through a plurality of locking fasteners 16. Each locking fastener 16 may be a conventional fastener, as would be understood by those of skill in the art, including for example a bolt, a screw, or the like. Desirably, each of the plurality of locking fasteners 16 may be inserted through each of (a) an aperture 17 associated with the outer frame 11 that is configured to receive such a locking fastener and (b) an aperture 18 associated with the canopy 12, and more desirably with a peripheral framework of the canopy, e.g. one or more rods 15, that is configured to receive such a locking fastener.

Figure 2:
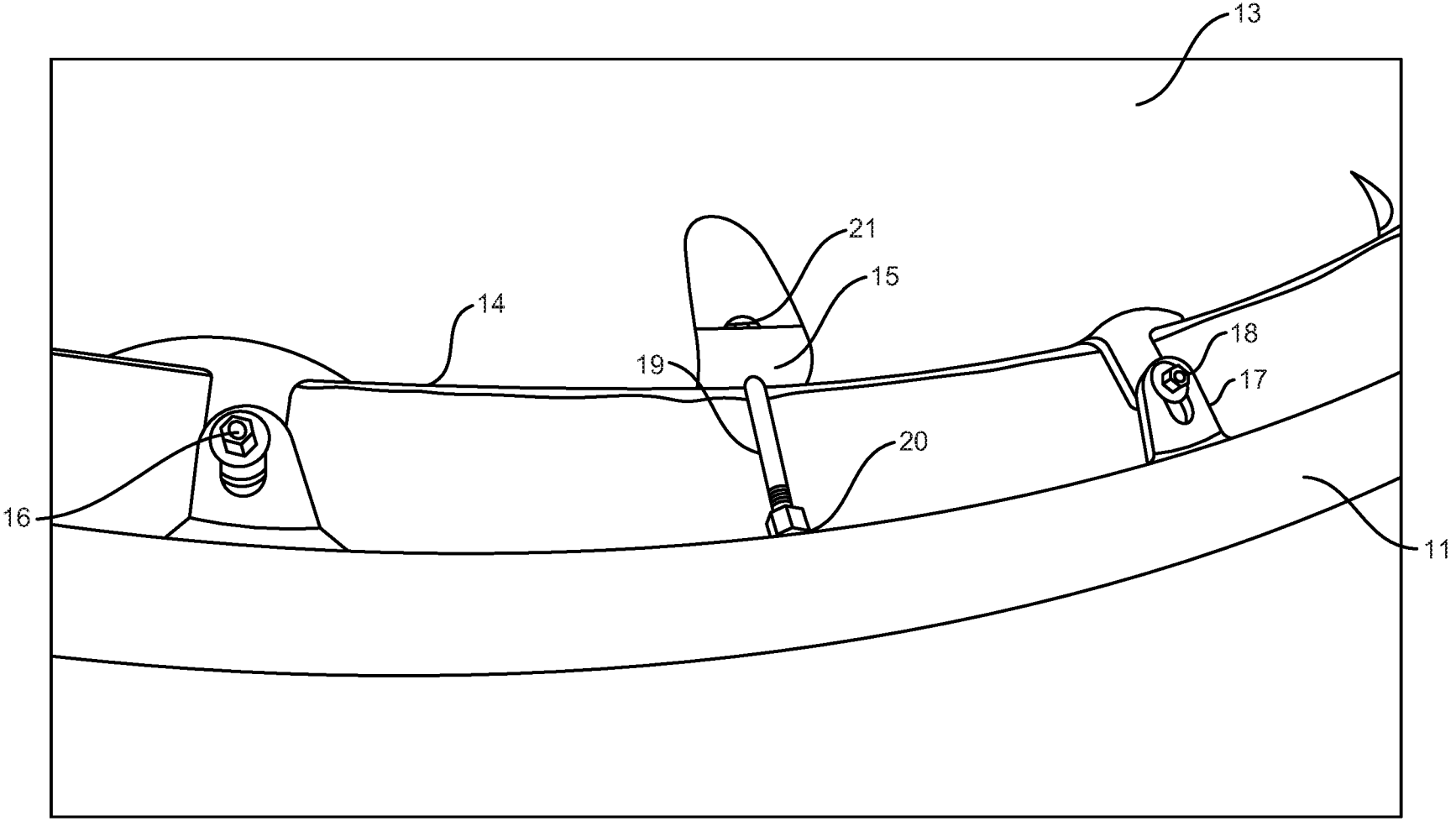
FIG. 2 shows a number of connections between a canopy and an outer frame, including a jack screw and a locking fastener, in an embodiment of a shade-providing structure of the present disclosure.

In some embodiments, such as is illustrated in FIG. 2, each of apertures 18 may be positioned on a tab, or outward projection, of the one or more rods 15. Similarly, as also illustrated in FIG. 2, each of apertures 17 may be positioned on a tab, or outward projection, of the outer frame 11.

By tightening the locking fastener 16 to secure the canopy 12 to the outer frame 11, the canopy may be locked in place at a desired tension. In some embodiments, at least one of the apertures 17, 18 has a length between an inner end (i.e. toward the center of the space defined by the outer frame) and an outer end (i.e. away from the center of the space defined by the outer frame). The locking fastener 16 may be inserted through the apertures 17, 18 at a number of locations along that length. This facilitates securement of the canopy 12 to the outer frame 11 at a desired tension. As explained herein, when installing the canopy 12, one may provide the canopy with a desired degree of tension within the space defined by the outer frame 11. In doing so, the distance between the canopy 12, and more particularly aperture 18, and the outer frame 11, and more particularly aperture 17 may vary. By allowing the locking fastener 16 to be inserted through apertures 17, 18 at a number of different locations (along a radial axis in the illustrated circular embodiment), one may secure the canopy 12 at any number of selected tensions. In other embodiments, the canopy 12 may be configured to have a predetermined tension within the outer frame 11, in which case an installer may simply provide the canopy with the degree of tension that will align aperture 18 with aperture 17 such that fastener 16 can be used to secure the canopy to the outer frame.

In other embodiments, a locking fastener 16 may be associated with one of the outer frame 11 or the canopy 12, and more particularly a peripheral framework of the canopy, e.g. one or more rods 15, in place of the above-described aperture 17, 18. In those embodiments, for example, a fastener 16 associated with the outer frame 11 may be affixed to the aperture 18 associated with the canopy 12 or a fastener 16 associated with the canopy 12 may be affixed to the aperture 17 associated with the outer frame 11. In yet other embodiments, the locking fastener 16 may comprise a clamp or a clip which may be used to secure a portion of the peripheral framework or rod 15, e.g. the tab described above, with a portion of the outer frame 11, e.g. the tab described above, such that neither element need contain the above-described apertures 17, 18. In some embodiments, the clamp or clip may be attached and/or secured at a variety of locations along a radial axis to allow for tensioning of the canopy 12 to a desired degree, as described herein. In other embodiments, the canopy 12 may be configured to have a predetermined tension within the outer frame 11, in which case the clamp or clip may only be attached and/or secured at a single location along the radial axis, i.e. at the location corresponding to the predetermined tension. In yet further embodiments, a portion of the peripheral framework or rod 15, e.g. the tab described above, may be welded to a portion of the outer frame 11, e.g. the tab described above, to secure the canopy 12 at a particular tension within the space defined by the outer frame.

In addition to the locking fasteners 16 that secure the canopy 12 to the outer frame 11, the shade-providing structure 10 may also comprise one or more jack screws 19, or similar tensioning devices, that allow for positioning of the canopy 12 relative to the outer frame 11 during (and optionally after) installation. In many embodiments, the structure 10 may comprise a plurality of jack screws 19. The jack screw(s) 19 may be used to provide the canopy material 13 with a desired degree of tension in order to ensure a taut canopy 12. For instance, by turning the one or more jack screws 19, one may bring the peripheral framework of the canopy closer to the outer frame 11, thereby stretching the canopy material 13, until the canopy material 13 is stretched tautly. If during that process the canopy 12 is over-tensioned, e.g. the canopy material 13 is too taut, one may simply operate the one or more jack screws 19 in the opposite direction so as to bring the peripheral framework of the canopy 12 away from the outer frame 11, thereby loosening the canopy material. The one or more jack screws 19 may be removed from the structure 10 after the canopy 12 is secured to the outer frame 11 or the one or more jack screws may be left in place, such as to facilitate post-installation tensioning adjustments.

In some embodiments, for instance that illustrated in FIG. 2, the outer frame 11 may comprise one or more apertures 20 configured to receive a jack screw 19. In many embodiments, it may be desirable that the outer frame 11 comprises a plurality of apertures 20 configured to receive a jack screw 19, such that the canopy 12 can be tensioned in multiple locations. Similarly, the canopy 12, and more desirably a peripheral framework of the canopy, e.g. one or more rods 15, may comprise one or more apertures 21 configured to receive a jack screw 19. Again, it may be desirable that each of a plurality of rods 15 comprises one or more apertures 21 or that a single rod comprises a plurality of apertures, such that the canopy 12 can be tensioned in multiple locations around its periphery.

Figure 3:
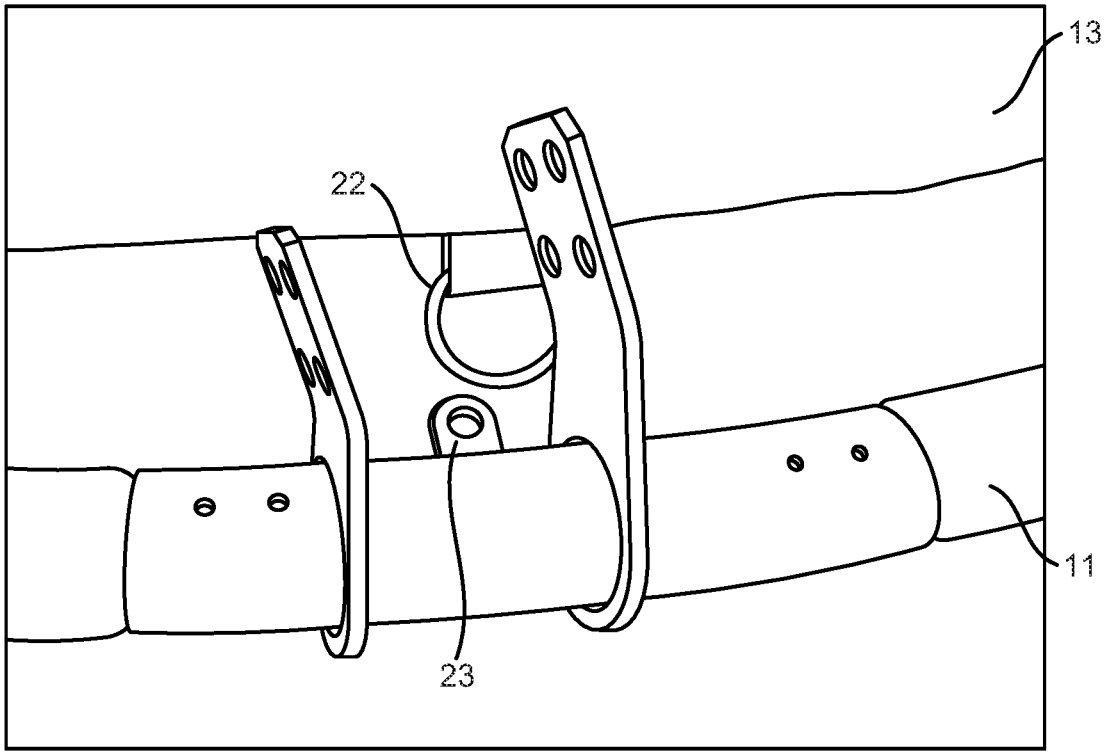
FIG. 3 shows an additional connection between a canopy and an outer frame, specifically a shackle element that may be used prior to tensioning, in an embodiment of a shade-providing structure of the present disclosure.

In some embodiments, the structure 10 may also comprise one or more shackle elements 22, which are configured to attach the canopy 12 to the outer frame 11 prior to stretching the canopy material 13 to selected tension. For example, as illustrated in FIG. 3, the canopy 12 may comprise shackle elements 22 at various locations around the periphery. Those shackle elements 22 may be affixed to the outer frame 11 to hold the canopy 12 in place and thereby facilitate tensioning of the canopy using the one or more jack screws 19 and the subsequent securement of the canopy to the outer frame by locking fasteners 16. As illustrated, each shackle 22 may comprise a clip that is attachable to the outer frame 11, for instance a clip that is attachable to an aperture 23 or corresponding shackle 24 associated with the outer frame. The shackles 22 may take on any of a variety of designs, however, so long as they hold the canopy in place within the space defined by the outer frame 11 to facilitate tensioning and securement. For instance, the shackles 22 may comprise one or more fabric strips extending from the periphery of the canopy 12 and configured to wrap around the outer frame element and be affixed by hook and loop fasteners, buttons, snaps, clips, tying in a knot, or the like. Additionally, although the shackle elements 22 are described above as being associated with the canopy 12, they may also be associated with the outer frame 11 and configured to by affixed to the canopy. Further, in some embodiments, the shackle elements 22 may be removable, such that after the canopy 12 has been secured (at a selected tension) to the outer frame, the shackle elements 22 may be removed from the structure 10.

Embodiments of the shade-providing structure 10 may be installed through a relatively simply process. First, the outer frame 11 is installed at the desired height and angle. Then, the canopy 12 is placed within the interior space defined by the outer frame 11 and, optionally, affixed to the outer frame by one or more shackles 22. Using one or more jack screws 19, the canopy material 13 is brought to a desired and selected tension. Once that tension has been obtained, the canopy 12 is secured in place by a plurality of locking fasteners 16.

In some embodiments, such as where subsections of the canopy material 13 may be independently tensioned, the final steps may be performed iteratively. For instance, a first section of the canopy material 13 may be brought to a desired tension using one or more jack screws 19 and then that section of the canopy 12 may be secured to the outer frame 11 such as by one or more locking fasteners 16. Next, a second section of the canopy material 13 may be brought to a desired tension using one or more jack screws 19 and then that section of the canopy 12 may be secured to the outer frame 11 such as by one or more locking fasteners 16. An installer may proceed to each section of the canopy 12 in turn. Alternatively, multiple sections of the canopy 12 may be tensioned using one or more jack screws 19 and then the multiple sections of the canopy may be secured to the outer frame 11 such as by one or more locking fasteners 16.

Using embodiments of the shade-providing structure 10 described herein, the tautness of the canopy material 13 may be adjusted with ease. For instance, one need simply loosen or remove one or more locking fasteners 16, operate the one or more jack screws 19 to obtain the desired tension, and reinsert and/or tighten the locking fasteners 16 to secure the canopy 12 to the outer frame 11 at the new tension. Similarly, removal of the canopy 12 from the outer frame 11 is easy. Therefore, in areas with particularly harsh weather systems, the canopy 12 can easily be removed to prevent damage. Further, one can replace an old and/or damaged canopy 12 at little cost and without any disassembly of the outer frame 11.

The outer frame 11 is typically placed in an elevated position, such as above a playground or playground structure, to provide a desired amount of shade. Accordingly, embodiments of the shade-providing structure 10 may include a plurality of posts 30 that support the outer frame 11 in an elevated position. Those posts 30 may take on any of a number of different configurations. To provide the most efficient support, the posts 30 may be equally spaced around the periphery (e.g. the circumference for a circular frame) of the outer frame 11.

In some embodiments, such as that illustrated in FIG. 1, each of the posts 30 may be curved outward, thereby providing an outer frame 11, and hence a shade-producing canopy 12, have larger dimensions than the footprint of the posts. Since the posts 30 are each curved outward, a portion of the posts 30 may be located vertically underneath the canopy 12.

Figure 4:
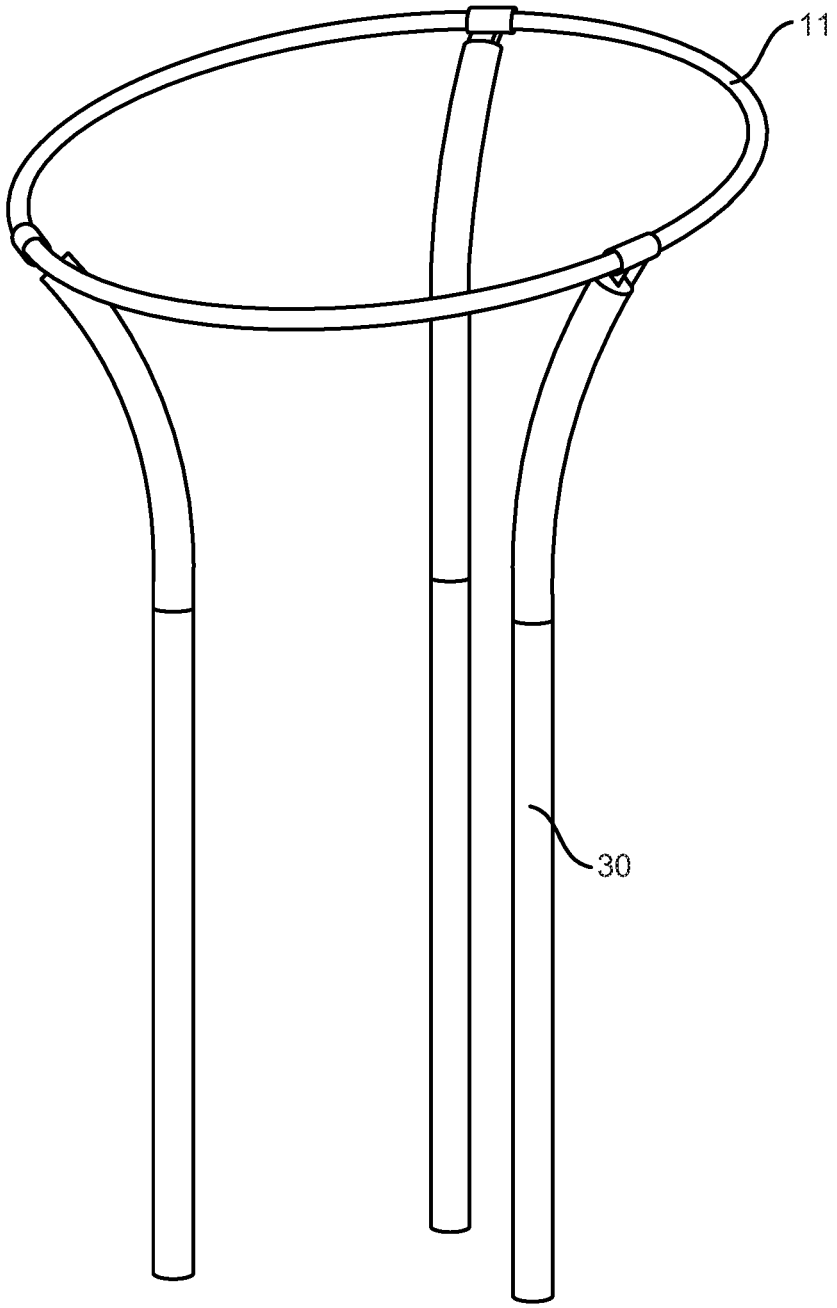
FIG. 4 is a perspective view of an elevated outer frame according to an embodiment of the present disclosure, in which the outer frame is elevated by three posts (compared to the four posts in the embodiment of FIG. 1).
Figure 5:
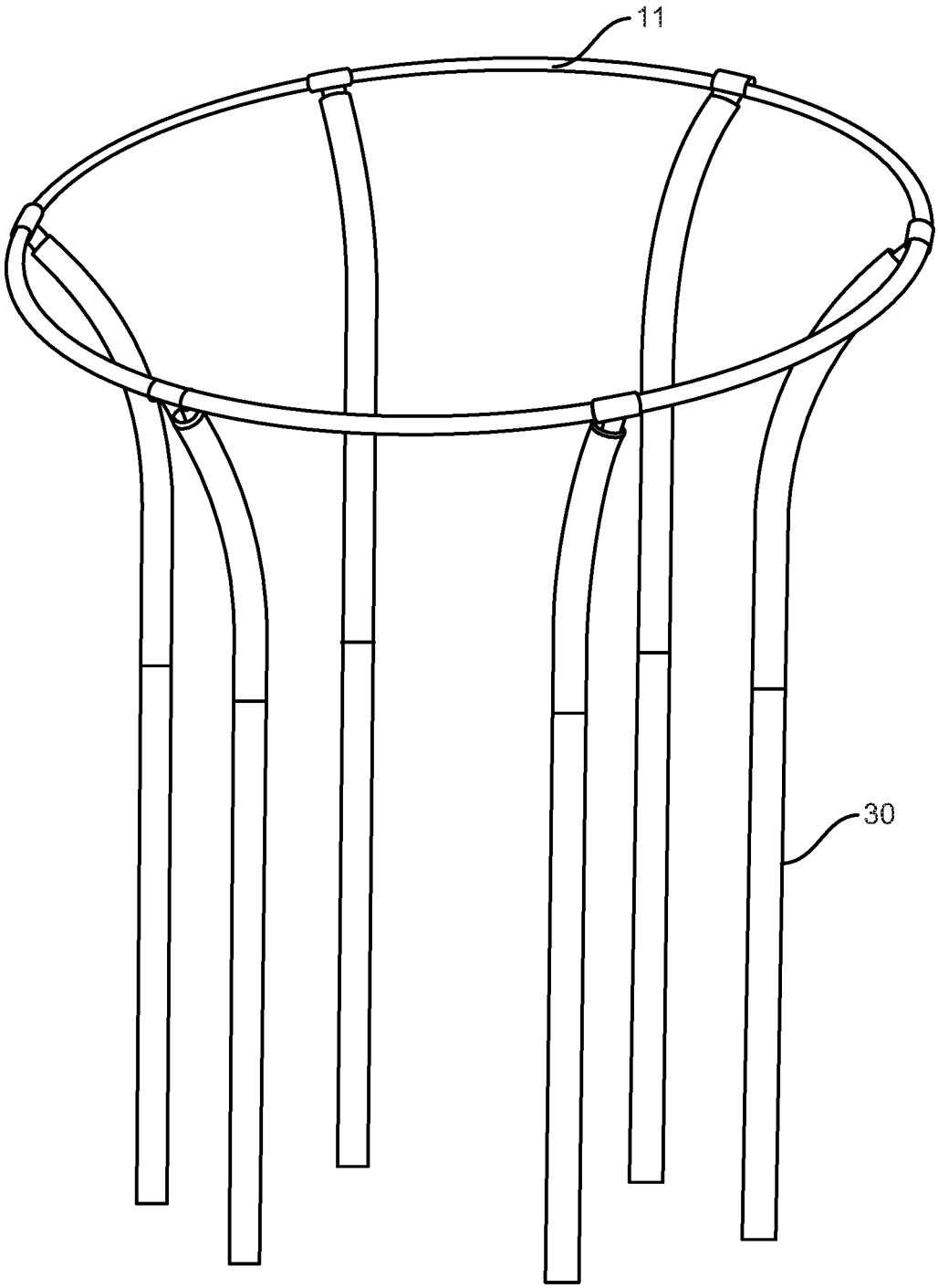
FIG. 5 is a perspective view of an elevated outer frame according to an embodiment of the present disclosure, in which the outer frame is elevated by six posts (compared to the four posts in the embodiment of FIG. 1).

Although the embodiment illustrated in FIG. 1 is shown having four posts 30, the number and size of the posts may be varied and selected based on the support requirements of the outer frame 11 (to which the canopy 12 is mounted) and the desired aesthetic. For instance, another embodiment of an elevated outer frame 11 is shown in FIG. 4. Because the outer frame 11 is smaller than that of FIG. 1, i.e. defines a smaller interior space, the frame may be supported by three posts 30. Similarly, an embodiment of an elevated outer frame 11 that defines a relatively large interior space is shown in FIG. 5. Because of the size of the outer frame 11, six posts 30 may be used to sufficiently support the frame in an elevated position.

Figure 6:
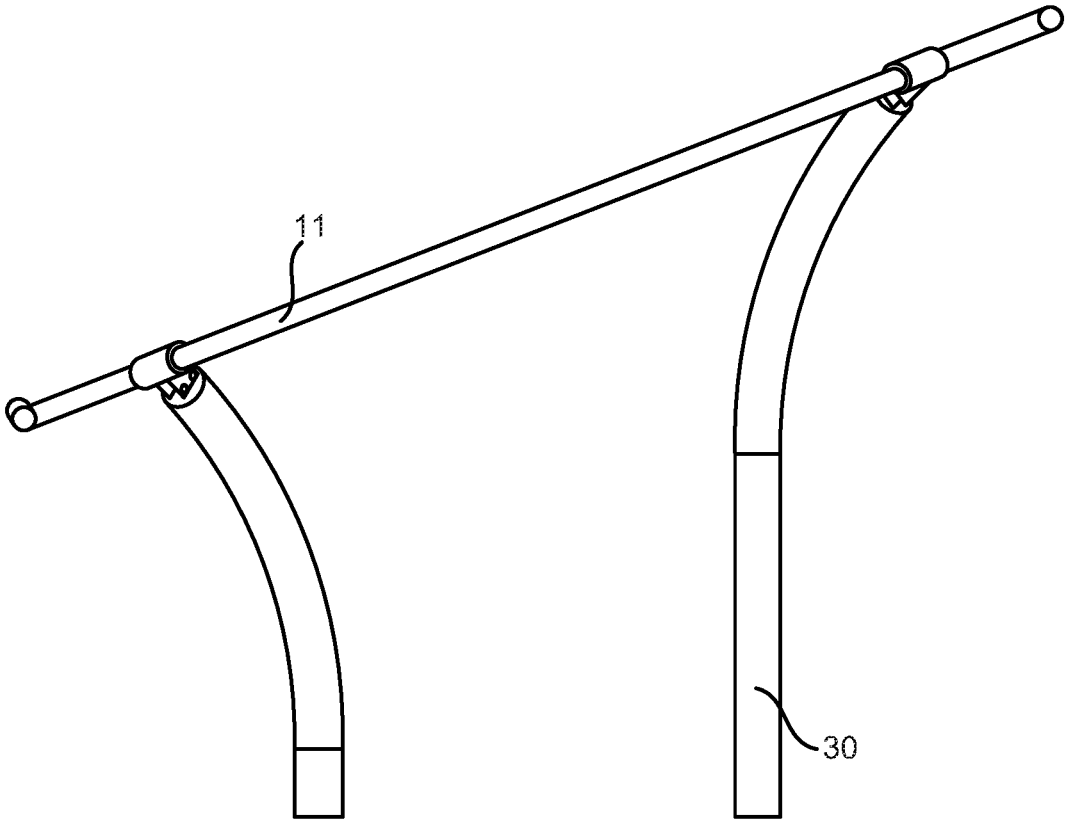
FIG. 6 is a side elevation view of the shade-providing structure of FIG. 1, showing the angled relationship of the structure to the horizontal, i.e. to the ground surface above which the structure is located.
Figure 7:
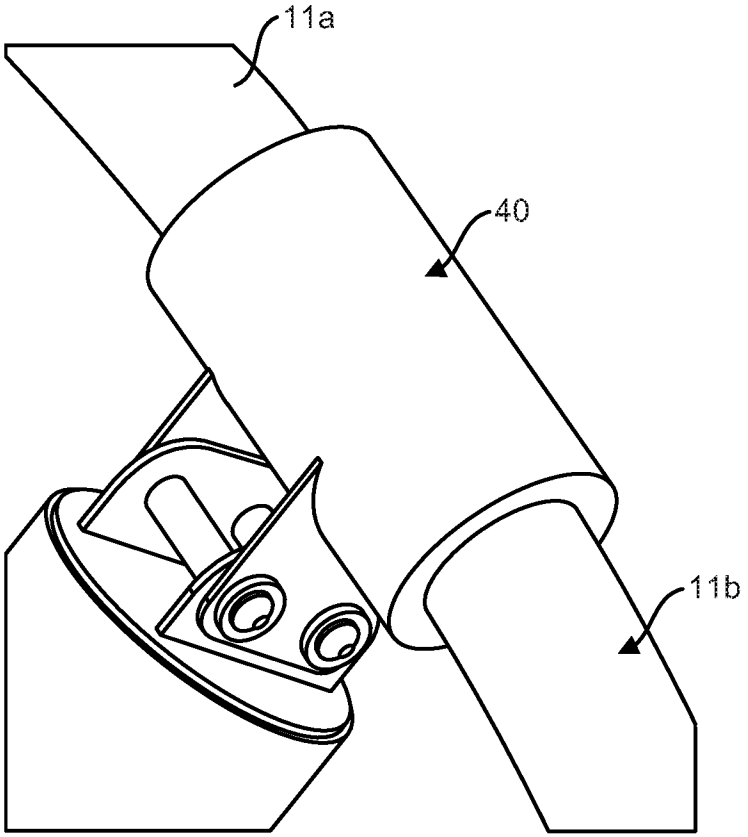
FIG. 7 shows an embodiment of a connection between the outer frame and a post that supports the outer frame in an elevated position.
Figure 7:
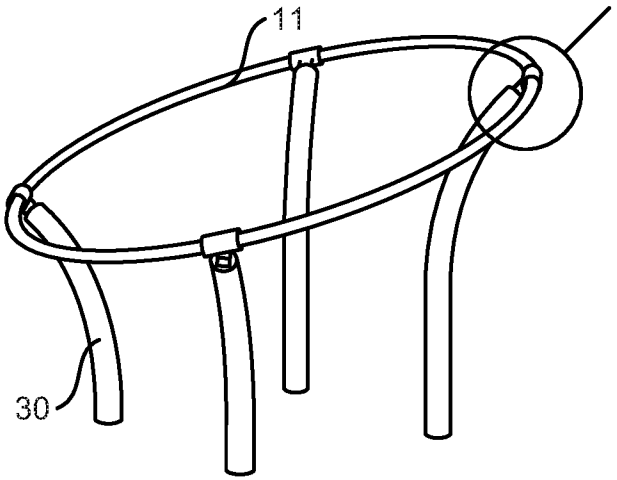

Additionally, as illustrated in FIG. 1, the shade-providing structure 10 may be positioned above a ground surface, such as the play surface of a playground, to form an angle with the ground surface. By angling the shade-producing canopy 12 in this manner, the amount of shade produced by the structure 10 can be maximized and/or the location of the shaded area may be controlled. Accordingly, one or more of the plurality of posts 30 may extend vertically to a greater height than one or more other of the plurality of posts. An example is illustrated in FIG. 6, in which the posts 30 on the right extend to a greater height than the posts on the left, thereby placing the outer frame 11, and thus the shade-producing canopy 12, at an angle with respect to the horizontal, i.e. with respect to the ground surface above which the shade-producing structure 10 is positioned.

In some embodiments, the shade-providing structure 10 may be angled at least 15 degrees with respect to the ground surface above which it is positioned. For instance, the shade-providing structure 10 may be angled between about 20 degrees and about 30 degrees with respect to the ground surface above which it is positioned, alternatively between about 15 degrees and about 45 degrees, alternatively between about 20 and 40 degrees.

The outer frame 11 may be attached to the posts 30 in any of a variety of manners. In some embodiments, the outer frame 11 may comprise a plurality of frame segments 11*a*, 11*b*. Those frame segments 11*a*, 11*b* may be linked by a connector element 40, which may extend from the top of each of the plurality of posts 30. The frame segments 11*a*, 11*b* may be welded to the connector 40 or they may be affixed to the connector by one or more fasteners (e.g. bolts). In other embodiments, connector elements 40 positioned at the top of each of the plurality of posts 30 may be configured to surround and enclose a portion of the frame 11. For instance, the connector element 40 may clamp around a portion of the frame 11 and be held in a clamped position by one or more fasteners (e.g. bolts).

Figure 10:
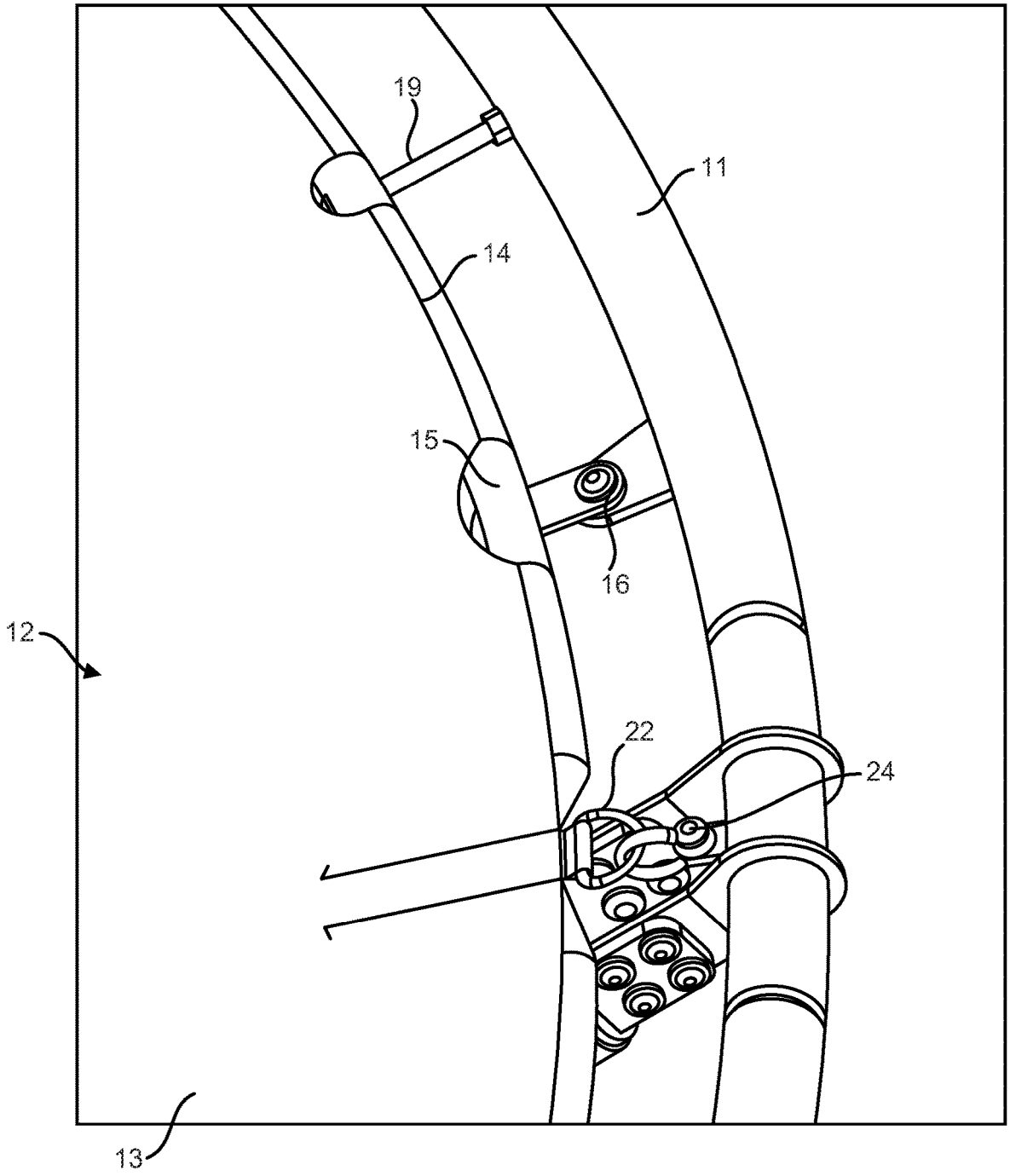
FIG. 10 shows a portion of the embodiment of FIG. 9, including the variety of connections between a canopy and an outer frame, e.g. a jack screw, a locking fastener, and a shackle element.
Figure 11:
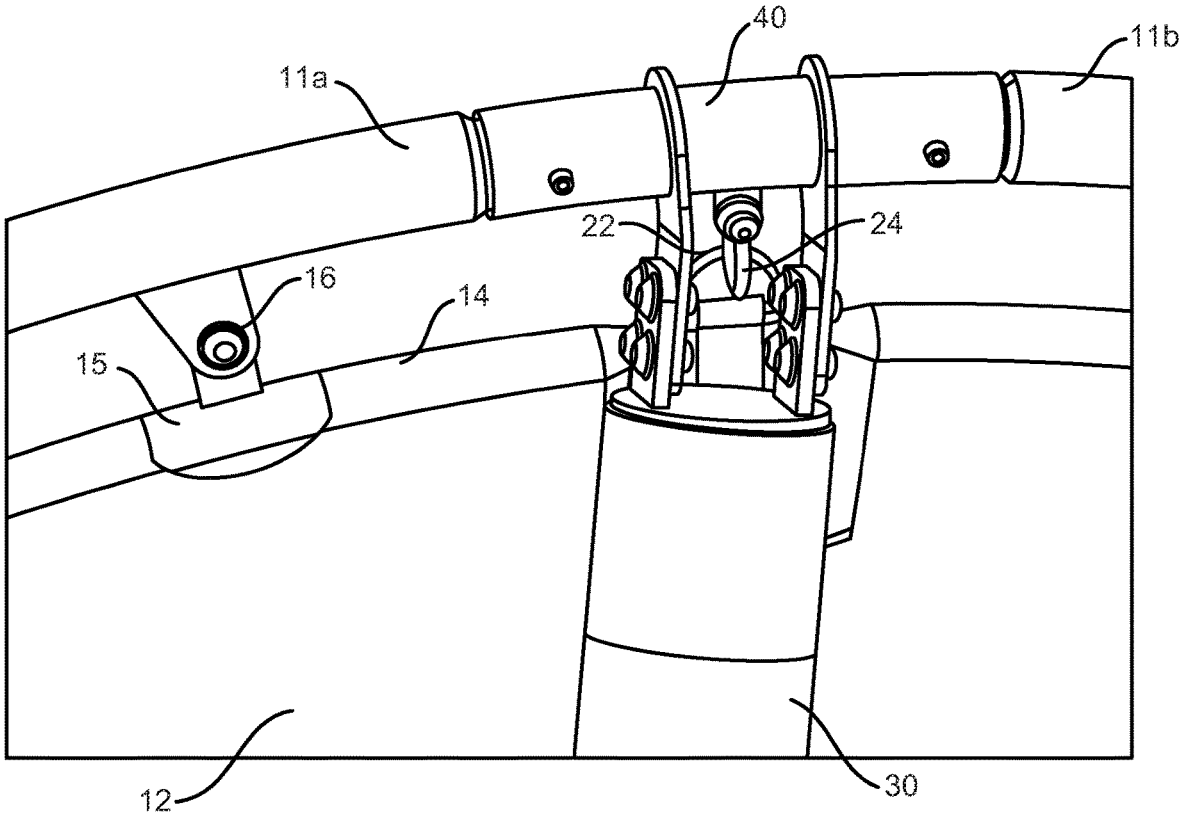
FIG. 11 shows the underside of a portion of the embodiment of FIG. 9 in the vicinity of the connection of the outer frame to a support post.

An example of a connection between the outer frame 11 and one of the posts 30 is shown in FIGS. 10 and 11. As illustrated, the ends of each of frame segments 11*a* and 11*b* are swaged so as to have a lesser diameter than the main body of the frame segment 11*a*, 11*b*. The swaged ends of the frame segments 11*a*, 11*b* may thus be inserted into hollow ends of connector 40. The swaged ends of frame segments 11*a*, 11*b* may be secured in place within connector 40 by one or more fasteners, such as can be seen in FIG. 11. By connecting the elements in this manner, the outer frame 11 may have a consistent diameter along its entire length, including the portions that are formed by connector 40. In the illustrated embodiment, connector 40 further comprises a pair of tabs affixed thereto (such as through welding), each of which is secured to an associated tab on an end of post 30, e.g. through conventional fasteners such as bolts.

As shown in FIGS. 10 and 11, the shackles 24 (or apertures 23) associated with the outer frame 11 may each be located on the connector elements 40. Positioning the shackles 24 at the connector elements 40 makes them easy to locate during installation, as an installer can go directly to each support post 30 to find each shackle.

Figure 8:
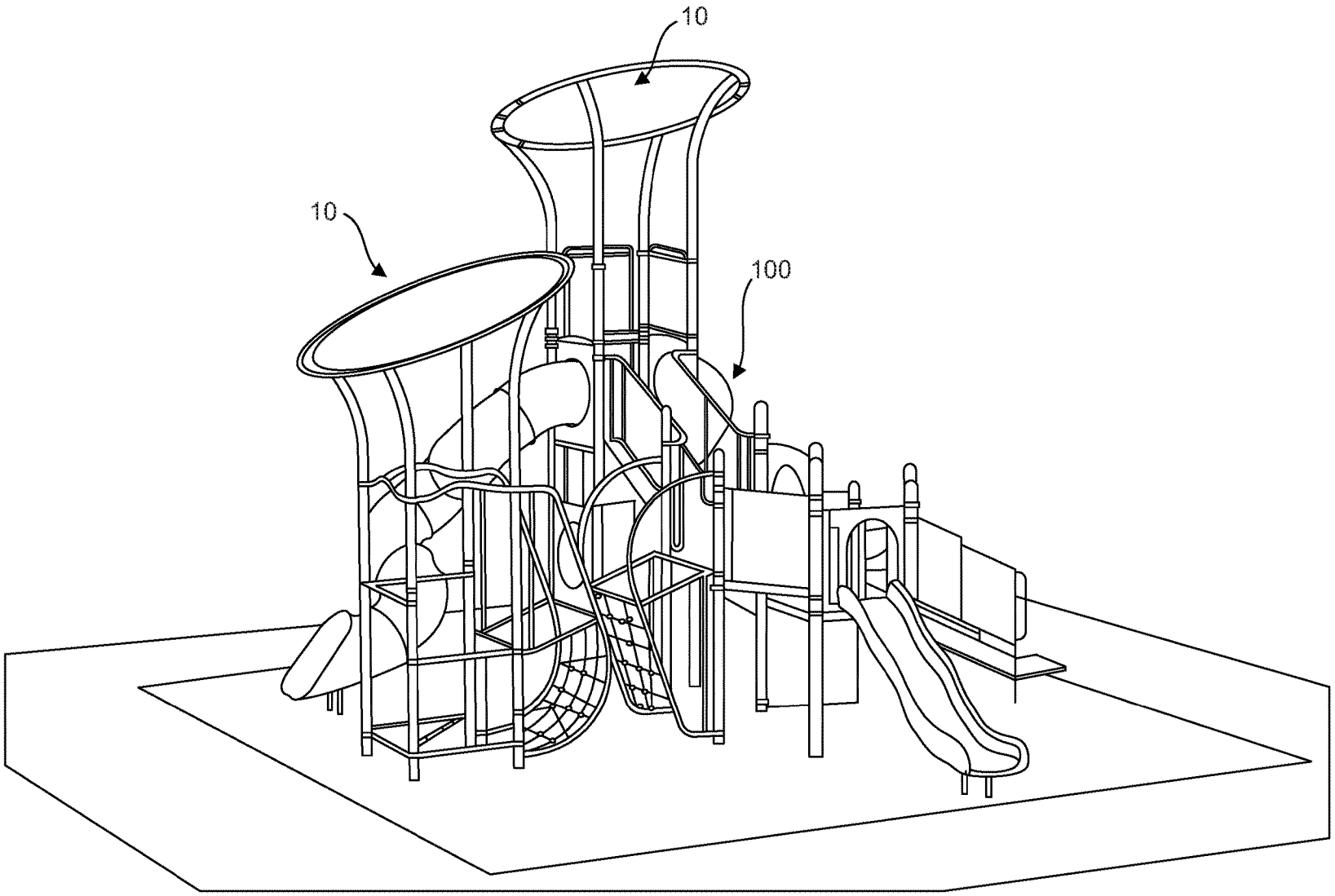
FIG. 8 shows an elevated playground structure comprising shade-providing structures according to an embodiment of the present disclosure.
Figure 9:
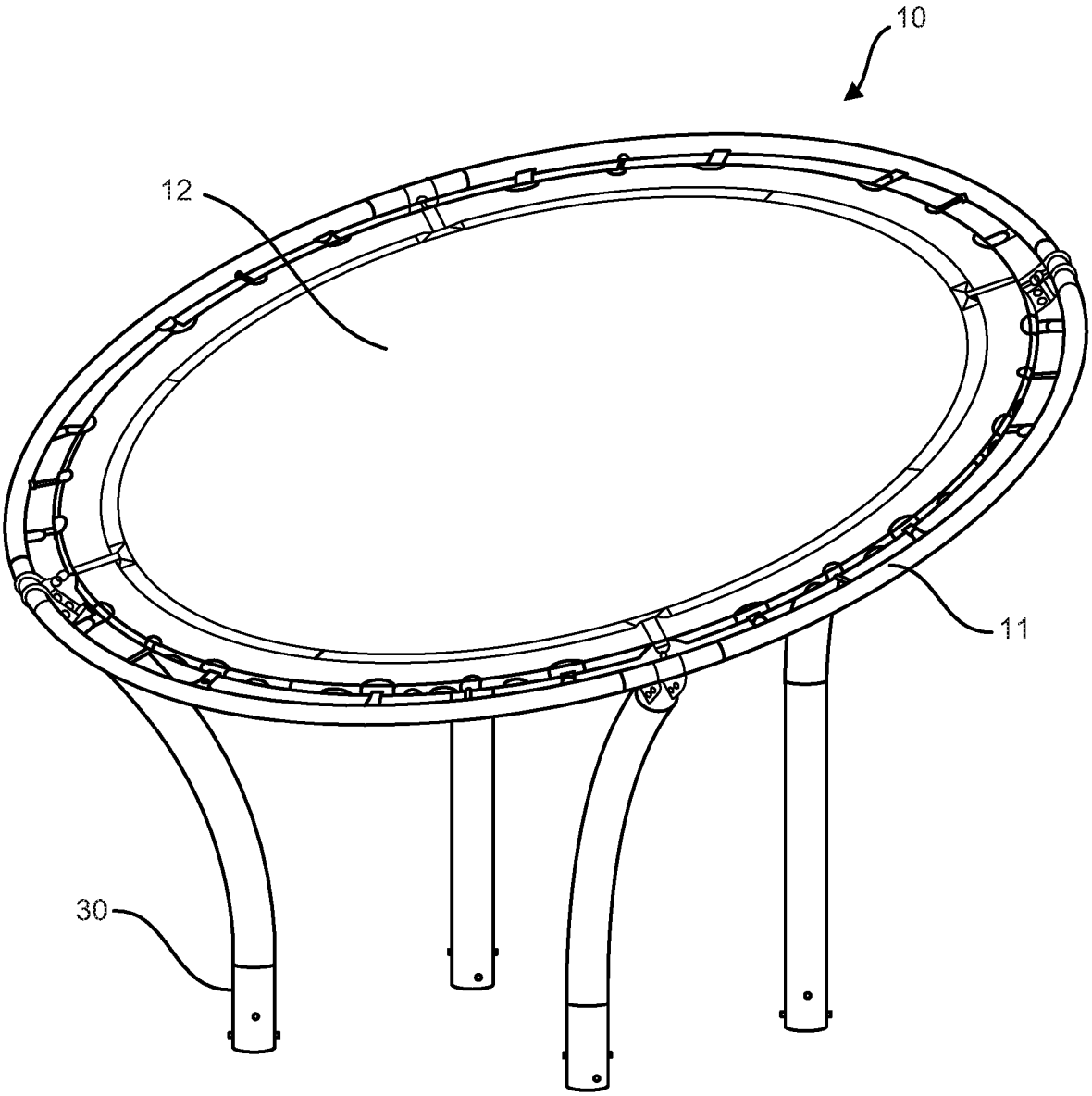
FIG. 9 is a perspective view of a shade-providing structure according to another embodiment of the present disclosure.

Embodiments of the present disclosure are also directed to playground structures 100, such as elevated playground structures containing one or more of the shade-producing structures 10 described herein. By mounting a shade-producing structure 10 to the top of a playground structure 100, one may provide large areas of shade for playing children. Additionally, the posts 30 that elevate the shade-producing structure 10 may also serve as supports for play elements, such as elevated platforms, slides, climbers, and the like. An example of such a playground structure 100 is shown in FIG. 8.

It can be seen that the described embodiments provide unique and novel shade-providing structures 10 that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A shade-providing structure comprising:

an outer frame defining an interior space, the outer frame comprising one or more apertures configured to receive a tensioning element;

a canopy positioned within the interior space and securely affixed to the outer frame, the canopy comprising a canopy material comprising one or more pockets spanning a periphery thereof, and one or more rods positioned within the one or more pockets, wherein the one or more rods comprises one or more apertures configured to receive a tensioning element; and a plurality of locking fasteners securing the canopy to the outer frame.

2. The shade-providing structure of claim 1, wherein the outer frame comprises a plurality of apertures configured to receive a locking fastener, the one or more rods comprises one or more apertures configured to receive a locking fastener, and each of the plurality of locking fasteners passes through the respective apertures on the outer frame and the one or more rods.

3. The shade-providing structure of claim 1, wherein the plurality of locking fasteners extend from at least one of the outer frame and the one or more rods.

4. The shade-providing structure of claim 1, wherein the outer frame comprises a plurality of apertures configured to receive a tensioning element.

5. The shade-providing structure of claim 4, wherein the canopy comprises a plurality of rods, each of the plurality of rods having one or more apertures configured to receive a tensioning element such that each of the plurality of rods can be independently tensioned.

6. The shade-providing structure of claim 1, wherein the outer frame is circular.

7. The shade-providing structure of claim 1, wherein the outer frame has a defined shape and the canopy has a shape that is substantially identical to the shape of the outer frame.

8. The shade-providing structure of claim 2, wherein each rod comprises one or more tabs that contain the one or more apertures configured to receive a locking fastener.

9. The shade-providing structure of claim 2, wherein the outer frame comprises one or more tabs that contain the plurality of apertures configured to receive a locking fastener.

10. The shade-providing structure of claim 1, further comprising a plurality of posts supporting the outer frame in an elevated position.

11. The shade-providing structure of claim 10, wherein each of the plurality of posts is curved.

12. The shade-providing structure of claim 11, wherein each of the plurality of posts is curved outward, such that a portion of the posts are located vertically underneath the canopy.

13. The shade-providing structure of claim 10, wherein the outer frame comprises a plurality of frame segments, and adjacent frame segments are linked by a connector element extending from the top of each of the plurality of posts.

14. The shade-providing structure of claim 1, wherein the shade-providing structure is positioned above a ground surface and wherein the outer frame forms an angle to the ground surface that is at least 15 degrees.

15. The shade-providing structure of claim 14, wherein the angle is between about 20 degrees and about 40 degrees.

16. The shade-providing structure of claim 1, wherein both the outer frame and the canopy have a circular shape.

17. The shade-providing structure of claim 1, wherein the outer frame comprises a plurality of connected frame segments.

18. The shade-providing structure of claim 1, wherein the canopy is configured to be brought to a selected tension by a removable tensioning element that is mountable to both the outer frame and the one or more rods.

19. The shade-providing structure of claim 1, further comprising an elevated playground structure to which the outer frame is mounted.

20. An elevated playground structure comprising the shade-providing structure of claim 1.

* * * * *